US010981689B2

(12) United States Patent
Altus et al.

(10) Patent No.: US 10,981,689 B2
(45) Date of Patent: Apr. 20, 2021

(54) MULTIPLE CONTAINER DEVICE

(71) Applicant: CANISTER SHOTGLASS LLC, West Palm Beach, FL (US)

(72) Inventors: Justin Grant Altus, West Palm Beach, FL (US); Andrew Gregory Levin, Palm Beach, FL (US)

(73) Assignee: CANISTER SHOTGLASS LLC, West Palm Beach, FL (US)

( * ) Notice: Subject to any disclaimer, the term of this patent is extended or adjusted under 35 U.S.C. 154(b) by 0 days.

(21) Appl. No.: 16/235,104

(22) Filed: Dec. 28, 2018

(65) Prior Publication Data

US 2019/0210757 A1 Jul. 11, 2019
US 2020/0290765 A9 Sep. 17, 2020

Related U.S. Application Data

(63) Continuation of application No. 13/969,934, filed on Aug. 19, 2013, now Pat. No. 10,167,104.

(60) Provisional application No. 61/684,139, filed on Aug. 17, 2012.

(51) Int. Cl.
*B65D 1/04* (2006.01)
*B65D 81/32* (2006.01)
*B65D 47/26* (2006.01)

(52) U.S. Cl.
CPC ..... *B65D 1/04* (2013.01); *B65D 47/265* (2013.01); *B65D 81/3211* (2013.01)

(58) Field of Classification Search
CPC .... B65D 1/04; B65D 47/265; B65D 81/3211; B65D 1/06
USPC ..... 215/6
See application file for complete search history.

(56) References Cited

U.S. PATENT DOCUMENTS 4,361,457 A * 11/1982 Keeler ..... B29C 51/14 156/224
4,603,784 A * 8/1986 Chang ..... A61J 9/00 215/10
4,779,722 A * 10/1988 Hall ..... A61J 1/2093 206/219
5,422,129 A * 6/1995 Draddy ..... B65D 21/08 215/10
5,598,928 A * 2/1997 Hossard ..... F42B 3/02 102/282
5,890,627 A * 4/1999 Storey ..... B65D 25/04 222/129

(Continued)

*Primary Examiner* — Ernesto A Grano
(74) *Attorney, Agent, or Firm* — Rothwell, Figg, Ernst & Manbeck, P.C.

(57) ABSTRACT

Disclosed is a dual container device comprising a bottom container comprising a first base, a top member comprising one or more first openings, and a first wall extending between the first base and the top member, a top container comprising a second base comprising one or more second openings, and a second wall extending from the second base, an intermediate wall extending either upwardly from the upper rim of the first wall or downwardly from the lower rim of the second wall, the intermediate wall for slidably receiving the container that is not attached thereto therethrough, and guides and tracks disposed on the interior surface of the intermediate wall and the exterior surface of the wall of the container received within the intermediate wall such that motion of the top container with respect to the bottom container is restricted to between an open position and a closed position.

17 Claims, 11 Drawing Sheets

(56) References Cited

U.S. PATENT DOCUMENTS 6,116,439 A * 9/2000 Yaniv ..... B65D 11/04 215/10
6,413,137 B1 * 7/2002 Myers, Sr. ..... A63H 5/00 215/11.1
6,415,624 B1 * 7/2002 Connors ..... B65D 21/0237 62/457.3
7,010,935 B2 * 3/2006 Citrynell ..... A47G 19/2255 62/457.3
7,331,478 B2 * 2/2008 Aljadi ..... A61J 9/00 215/11.1
7,866,183 B2 * 1/2011 Roth ..... F25D 3/08 62/457.3
8,146,758 B1 * 4/2012 Peres ..... B65D 81/3205 215/6
8,292,099 B1 * 10/2012 Wahlstrom ..... A61J 1/2031 215/6
D683,590 S * 6/2013 Austin ..... D7/510
8,459,450 B1 * 6/2013 Whitaker ..... A61J 9/00 206/219
8,485,378 B2 * 7/2013 Zoss ..... A47G 19/02 220/23.86
8,672,123 B1 * 3/2014 Vallejo ..... A61J 9/00 206/219
8,844,758 B1 * 9/2014 Kummer ..... B65D 71/502 220/636
8,857,636 B2 * 10/2014 Sullivan ..... B65D 11/188 215/6
9,004,301 B2 * 4/2015 Wahlstrom ..... A61J 9/00 215/6
9,228,737 B2 * 1/2016 Steinmann ..... F21V 21/12
9,289,356 B2 * 3/2016 Farber ..... A61J 9/00
9,629,782 B2 * 4/2017 Hayes ..... A61J 11/04
9,782,036 B2 * 10/2017 Alexander ..... H05B 3/0014
10,226,153 B2 * 3/2019 Trager ..... B65D 81/3211
10,357,797 B2 * 7/2019 Coe ..... B05C 17/0052
10,442,569 B2 * 10/2019 Gersovitz ..... B65D 21/0227
10,660,982 B2 * 5/2020 Gazzelli ..... B65D 25/10
2009/0178940 A1 * 7/2009 Said ..... B65D 81/3205 206/221
2010/0084362 A1 * 4/2010 Letchinger ..... B65D 11/04 215/200
2011/0100945 A1 * 5/2011 Gutierrez ..... A61J 9/00 215/11.5
2013/0284764 A1 * 10/2013 Baxter-Waller ..... B05B 11/0056 222/321.9

* cited by examiner

MULTIPLE CONTAINER DEVICE

CROSS-REFERENCE TO RELATED APPLICATIONS

This application is a continuation, which claims priority to U.S. Non-Provisional application Ser. No. 13/969,934 entitled, "Multiple Container Device", filed Aug. 19, 2013, now U.S. Pat. No. 10,167,104, issued Jan. 1, 2019, which claims priority to and the benefit of U.S. Provisional Patent Application No. 61/684,139, entitled "DUAL CONTAINER DEVICE" filed Aug. 17, 2012, the contents of which are herein incorporated by reference in their entirety.

FIELD

The present invention relates to beverage containers and more particularly to multiple compartment containers that enable a user to consume liquids and other consumables, such as beverages or medicine, within each compartment in a sequential manner.

BACKGROUND

An alcohol consumer upon consuming a shot (i.e., a glass of alcoholic drink), generally follows it up with a chaser to tone down the effect of the stronger shot. The chaser could be any milder beverage such as a beer, juice, or even water. It is recommended that the chaser be consumed immediately after consuming the shot. Usually, the two beverages, i.e., the shot and the chaser, are served in two different containers and as a result of it, an alcohol servicing establishment, such as a bar, nightclub, etc., has to manage two containers per customer, which is an inconvenience to begin with. Especially, at peak business hours, this affair of juggling between multiple containers becomes all the more inconvenient due to multiple consumers, space constraints, and etc. One undesirable outcome that might arise out of the mismanagement is the delay in serving the chaser, which, as mentioned earlier, is not recommendable. There is certainly a need in the art for a solution involving beverage containers that can significantly smooth down the operations at an alcohol serving establishment and enhance the drinking experience.

SUMMARY

The present invention is a dual container device that includes two containers, viz., an open top container and a closed bottom container, which are removably coupled together by track and guide mechanism. More particularly, the top container is adapted to be received over the bottom container such that, the base of the top container and the top of the bottom container abut each other. The base of the top container and the top of the bottom container includes a plurality of openings whereby, a beverage poured into the top container is received into the bottom container through the openings. The track and guide mechanism, about which the top and bottom containers are held together, is arranged such that, the top container can be rotated relative to the bottom container and vice versa. More particularly, the rotation of the containers relative to each other is restricted to between an open position, where the openings on the top and bottom containers are aligned to as allow the passage of a beverage between the containers, and a closed position, where, the openings on the containers overlap so as to seal off the bottom container.

In a first embodiment of the invention, there is provided a dual container device. The device includes a bottom container including a first base, a circular top member disposed opposite to the first base, and a first circumferential wall extending between the first base and the top member so as to form a closed container, the top member including one or more first openings. The device also includes a top container including a circular second base and a second circumferential wall extending upwardly from the second base, the second base including a one or more second openings. The device further includes a cylindrical intermediate circumferential wall extending either upwardly from an upper rim of the first circumferential wall or downwardly from the lower rim of the second circumferential wall, the intermediate wall for slidably receiving a one of the top container and the bottom container that is not attached thereto through an open end thereof such that, a top surface of the top member and a bottom surface of the second base abut each other. The device additionally includes at least one corresponding guide and track disposed on the interior surface of the intermediate circumferential wall and the exterior surface of the wall of the one of the top container and the bottom container such that a rotary motion of the top container and the bottom container with respect to each other, is restricted to an open position where the first openings and the second openings are aligned so as to allow the passage of a beverage between the top container and the bottom container and a closed position where the first openings and second openings overlap to substantially seal off the bottom container from the top container.

In the device, the first and second walls can be cylindrical. Further, the outer surfaces of the intermediate circumferential wall can be flush with at least a portion of outer surfaces the top container and the bottom container.

In the device, the track can be a horizontal track section with both extremities thereof being closed. Further, the corresponding guide and track can be structurally configured to achieve a snap fit as the guide reaches the horizontal extremities of the horizontal track section. The track can include a vertical track section extending from the midpoint of the horizontal track section with a free end thereof being open.

In the device, one of the first container and the second container received within the intermediate circumferential wall can extend beyond the open end of the intermediate circumferential wall. Also, each of the first and second openings can be substantially triangular in shape.

In a second embodiment of the invention, a dual container device is provided. The device includes a bottom container including a first base, a circular top member disposed opposite to the first base, and a first circumferential wall extending between the first base and the top member so as to form a closed container, the top member including a plurality of first openings. The device also includes a top container including a circular second base and a second circumferential wall extending upwardly from the second base, the second base including a plurality of second openings. The device further includes a cylindrical intermediate circumferential wall extending either upwardly from the upper rim of the first wall member or downwardly from the lower rim of the second wall member, the intermediate wall for slidably and removably receiving the container that is not attached thereto through the open end thereof such that, the top surface of the top member and the bottom surface of the second base abut each other. The device also includes a plurality of guides and tracks disposed on the interior surface of the intermediate wall and the exterior surface of the wall of the container that is received within the intermediate wall such that, the rotary motion of the top container with respect to the bottom container, or vice versa, about the longitudinal axis of the dual container device is restricted to between an open position, where the first and the second openings are aligned so as to allow the passage of a beverage from the top container to the bottom container and vice versa, and a closed position where, the plurality of first and second openings overlap sealing off the bottom container.

In a third embodiment of the invention, there is provided a dual container device. The device includes a first container including a first base, a top member, and at least one first wall extending between the first base and the top member so as to form a first container space, the top member including one or more first openings. The device also includes a second container including a second base and at least one second wall extending upwardly from the second base so as to form a second container space, the second base including one or more second openings. The device further includes at least one intermediate wall extending from one of the first container or the second container and including an opening for receiving an other of the first container and the second container such that an outer surface of the top member and an outer surface of the second base abut each other to yield abutting surfaces. The device also includes at least one corresponding guide and track disposed on an interior surface of the at least one intermediate wall and an exterior surface of the other one of the first container and the second container, wherein the at least one corresponding guide and track are configured such that a motion of the first container and the second container with respect to each other causes the abutting surfaces to transition between at least one open position and at least one closed position. In the device, the first openings and the second openings are arranged in the at least one open position so as to connect the first container space and the second container space, and wherein the first openings and the second openings are arranged in the closed position to substantially isolate the first container space from the second container space.

In the device, the at least one first wall, the at least one second wall, and the at least one intermediate wall can be cylindrical. Further, the outer surfaces of the at least one intermediate wall are flush with outer surfaces of the first container and the second container.

Also in the device, the track can include a horizontal track section with both extremities thereof being closed. Further, a corresponding guide and track can be structurally configured to achieve a snap fit as the guide reaches the horizontal extremities of the horizontal track section. Additionally, the track can include a vertical track section extending from the midpoint of the horizontal track section with a free end thereof being open. In the device, the vertical track section can be configured such that the guide squeezes past the extremity of the vertical track section into the horizontal track section so as to minimize the chance of accidental disassembling of the top and bottom containers.

In the device of claim, the other of the first container and the second container received within the intermediate wall can extends beyond the opening of the intermediate wall. Further, each of the first and second openings can be substantially triangular in shape.

The other objects and advantages of the embodiments herein will become readily apparent from the following detailed description taken in conjunction with the accompanying drawings.

BRIEF DESCRIPTIONS OF THE DRAWINGS

Figure 1:
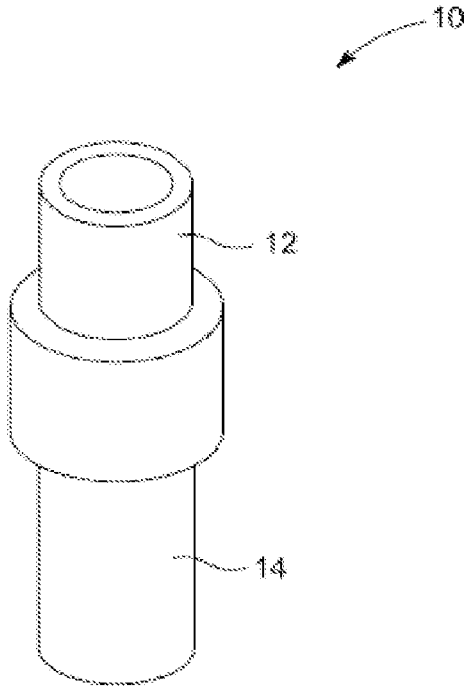
FIG. 1 is a perspective view of the dual container device according to an embodiment of the present invention.

FIGS. 12A and 12B, and 13A and 13B depict the operation of the device according to the embodiment of the present invention shown in FIG. 1.

Figure 14:
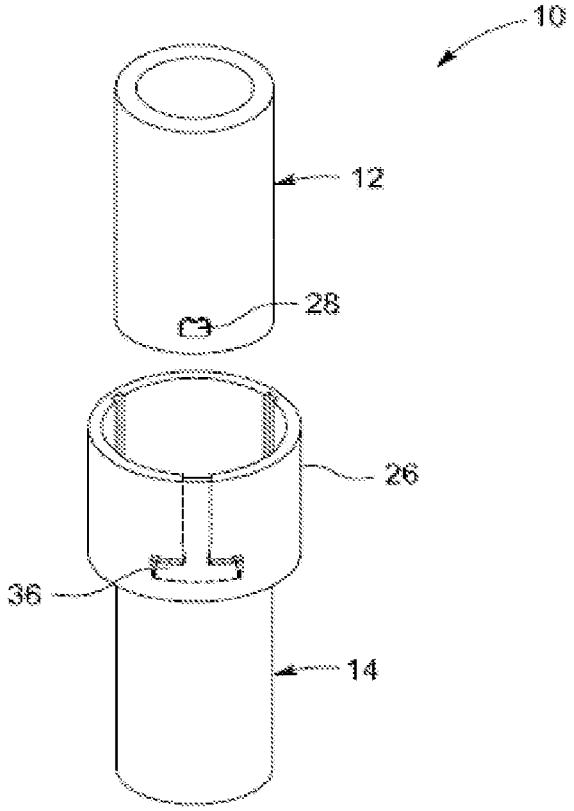

FIG. 14, according to an alternate embodiment of the present invention, is an illustration of the dual container device.

Figure 15:
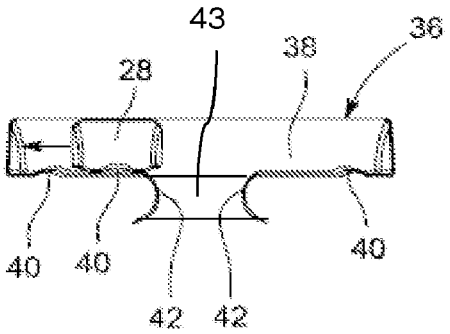

FIG. 15, according to another embodiment of the present invention, is an illustration of the T-track and guide combination.

Figure 16:
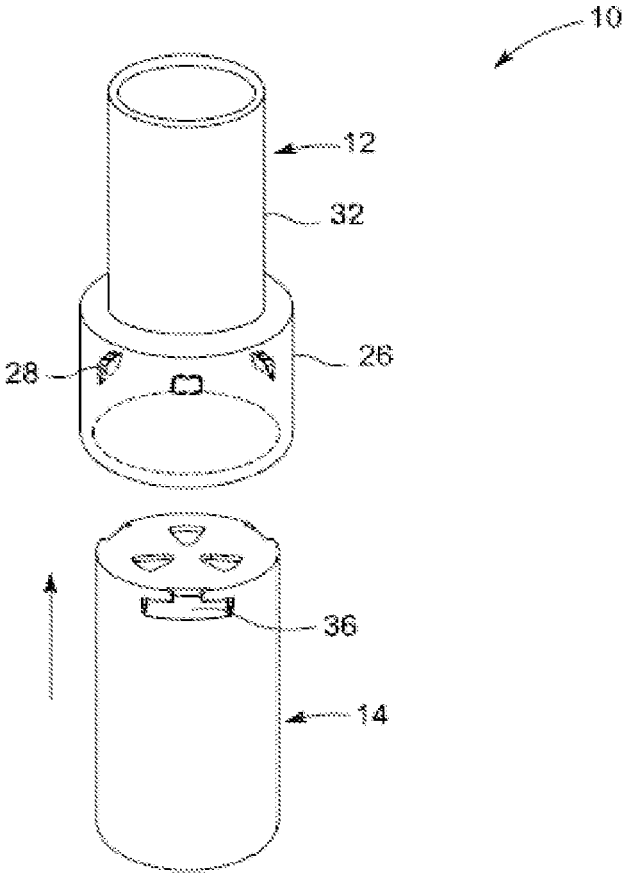
Figure 17:
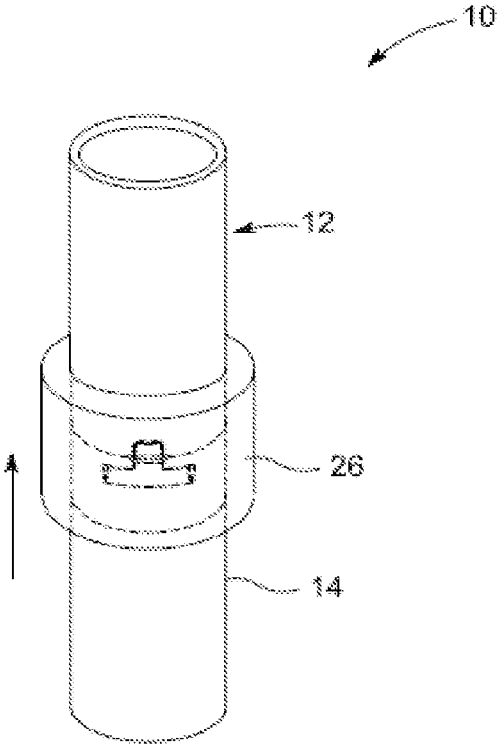
Figure 18:
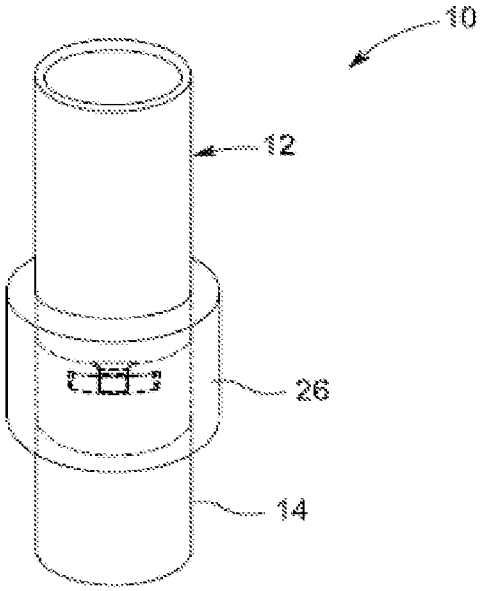

FIGS. 16 through 18 depict the bottom container being received within the top container in a sequential manner according to an alternate embodiment of the present invention.

Figure 19A:
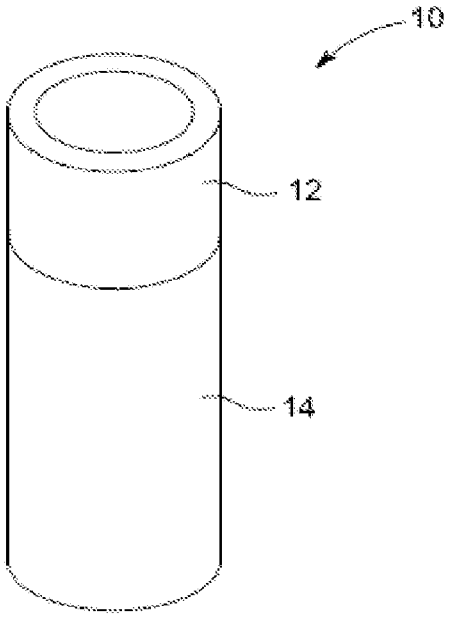
Figure 19B:
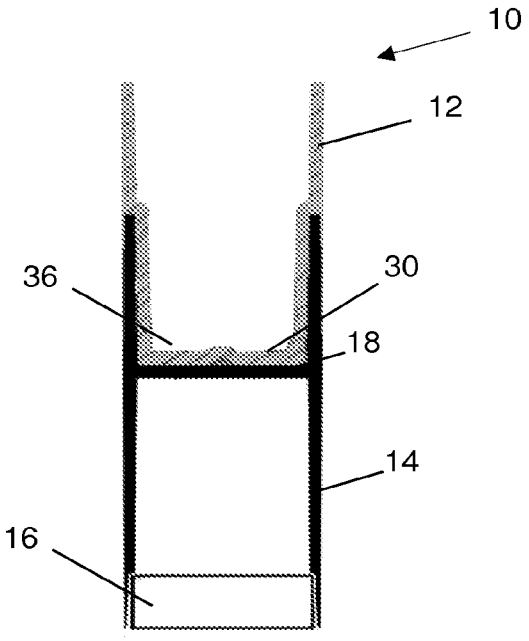

FIGS. 19A and 19B are perspective and cross-section views of the dual container device according to another embodiment of the present invention.

FIGURES—REFERENCE NUMERALS

10 . . . Dual Container Device
12 . . . Top Container
14 . . . Bottom Container
16 . . . First Base
18 . . . Top Member
20 . . . First Circumferential Wall
21 . . . O-Ring
22 . . . Central Circular Track (Base)
23 . . . Central Circular Track (Bottom Container)
24 . . . First Opening
26 . . . Intermediate Circumferential Wall
28 . . . Guide On the guide the notch is not mentioned.
30 . . . Second Base
32 . . . Second Circumferential Wall
34 . . . Second Opening
36 . . . T-track
38 . . . Horizontal Section
40 . . . Crest
42 . . . Bump
43 . . . Ridge

DETAILED DESCRIPTION

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments are directed to containers for liquids and consumables, and more particularly to multiple compartment containers that enable a user to consume liquids and other consumables, such as beverages or medicine, within each compartment in a sequential manner. Although the various embodiments will be described below primarily with respect to the consumption of a beverage, this is solely for ease of illustration. However, as noted above, the various embodiments can be utilized in variety of ways. For example, the containers of the various embodiments can be utilized for the consumption of medicines, powders, granular substances, juices. Moreover the various embodiments can be utilized with any combination of liquids and consumables.

Referring to FIG. 1, an embodiment of the present invention is directed to a dual container device 10 including two containers viz., a top container 12 and a bottom container 14 held together by a releasably lockable mechanical arrangement. The device 10 is basically designed to hold a beverage or two different beverages in each container separately for sequential consumption thereof, at the will of the user thereof. The mechanical technique (or arrangement) employed by device 10 enables the bottom container 14 to be opened and closed, and this forms the crux of the utility of the device 10. More will be discussed on this aspect (i.e., the mechanical arrangement) of the invention in the following body of text.

Referring to FIGS. 2 through 5D, the bottom container 14 includes a first base 16, a top member 18, and a first circumferential wall 20 extending between the first base 16 and the top member 18. The first base 16 can be a circular member with planar top and bottom surfaces. However, the various embodiments are not limited in this regard and each of the top and bottom surfaces of the first base 16 can have a non-planar shape (e.g., with a cross-section that defines a parabolic shape or polygon shape. Further, the top and bottom surfaces can be different from each other. The first base 16 and the top and bottom surfaces thereof, however, can be of any shape known in the art as long as the utility of the device 10 is not affected. In one embodiment, the first base 16 is designed to be removable so as to access the interior of the bottom container 14 for cleaning purposes. In the illustrated embodiments, the first base 16 includes a central circular track 22 along the circumference thereof, as shown in FIG. 5A. In some embodiments, the track 22 can be configured for snugly receiving a rubber o-ring 21 therewithin so as to ensure an airtight seal to prevent any leakages, as shown in FIG. 5B. In other embodiments, the track 22 can be configured as a protruding rim (not shown) for tightly fitting against the wall of the bottom container so as to ensure an airtight seal to prevent any leakages. More particularly, as can be appreciated from the referred drawings, the o-ring or the protruding rim abuts the interior surface of the first wall 20 as the first base 16 is received within the bottom container 14.

Figure 5A:
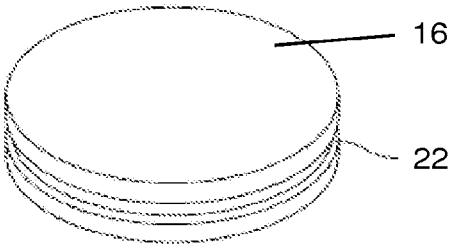
FIG. 5A is a perspective view of the removable first base according to an embodiment of the present invention.
Figure 5B:
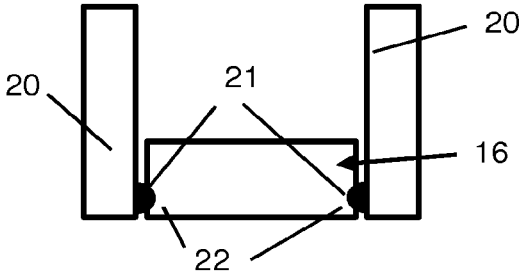
FIGS. 5B-5F are various views of the removable first base inserted into the bottom container according to various embodiments of the present invention.
Figure 5C:
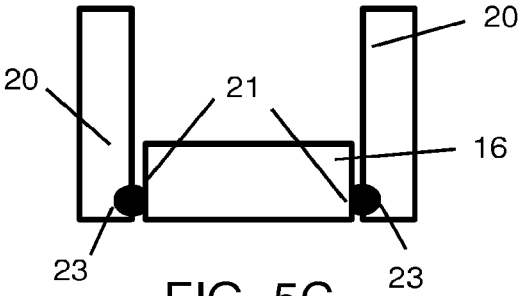

In some embodiments, the bottom container 14 can include a track 23 for snugly receiving the rubber o-ring 21 therewithin so as to ensure an airtight seal to prevent any leakages, as shown in FIG. 5C. In other embodiments, this track can be configured as a protruding rim (not shown) for tightly fitting against the wall of the bottom container so as to ensure an airtight seal to prevent any leakages. More particularly, as can be appreciated from the referred drawings, the o-ring or the protruding rim abuts the exterior surface of the first base 16 as the first base 16 is received within the bottom container 14. Moreover, in some embodiments, both the first base 16 and the bottom container 14 can include o-rings or protruding members.

Figure 5D:
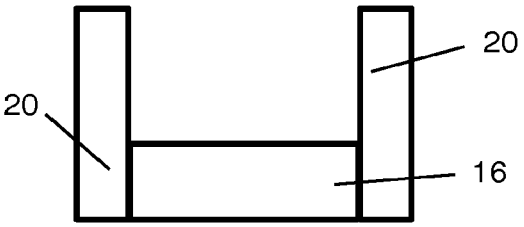

In yet other embodiments, first base 16 and the bottom container 14 can be configured without any type of track, and thus without an o-ring or a protruding rim. In such embodiments, as shown in FIG. 5D the first base 16 and the bottom container 14 can be dimensioned such the outer surfaces of the first base 16 abut the inner surfaces of the bottom container 14 to provide an airtight seal.

Figure 5E:
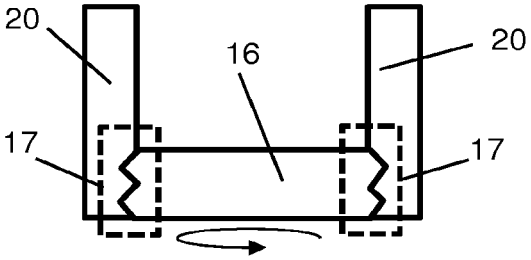

In yet other embodiments, first base 16 and the bottom container 14 can be configured to attach to each other via threading. In such embodiments, as shown in FIG. 5E, the first base 16 and the surfaces of the first wall 20 can be configured to include corresponding threads 17. Thus, the first base 16 can be screwed onto the bottom container 14 to provide an airtight seal. In some configurations, an o-ring can also be included in combination with the threads 17.

Figure 5F:
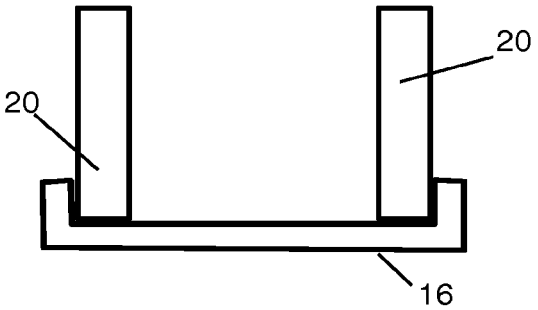

Although the exemplary embodiments of FIGS. 5A-5E are configured such the side surfaces of the first base 16 engage with the inner surface of the first wall 20, the various embodiments are not limited in this regard. In other embodiments, the first base 16 can be configured to engage with the outer surface of the first wall, as shown in FIG. 5F. In such embodiments, any of the methods described above with respect to FIGS. 5A-5E can be utilized to attach the first base to the bottom container and provide an airtight seal.

It should also be noted that in some embodiments, the portion of the inner surfaces of the bottom container 14 that engages with the first base can be a counterbore region. That is the portions of walls 20 abutting first base 16 can be thinner than other portions of walls 20, The top member 18 is also shown as a circular member with planar top and bottom surfaces. But unlike the first base 16, it is preferable for the top member 18 to be circular in shape and the top surface thereof to be planar. The top member 18 can include one or more first openings 24 disposed thereon for allowing the passage of a beverage in and out of the bottom container 14. The first openings 24 can of any number and each of which, can be of any shape. In some embodiments, each first opening 24 is of triangular shape with the corners thereof being rounded off. Moreover, each second opening 24, as can be appreciated from the referred drawings, extends beyond the circumferential edge of the second base 30 and therefore is an open opening. In one embodiment, similar to the first base 16, the top member 18 is designed to be removable and sits over the rim of the first wall 20. The upper surface of the top member 18 can be lined with a rubbery material.

Figure 2:
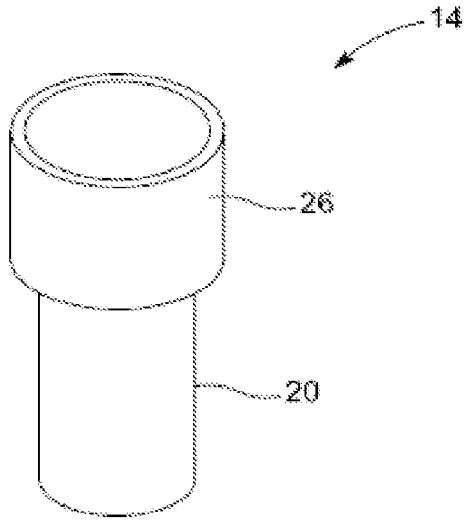
FIG. 2 is a perspective view of the bottom container according to the embodiment of the present invention shown in FIG. 1.
Figure 3:
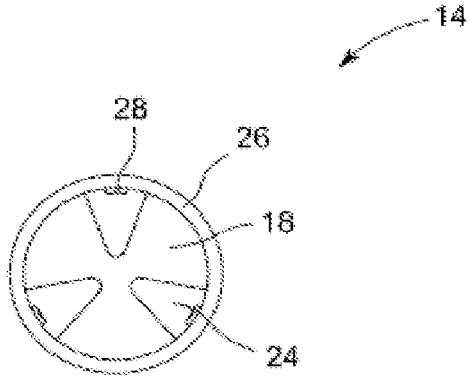
FIG. 3 is a top plan view of the bottom container according to the embodiment of the present invention shown in FIG. 1.
Figure 4:
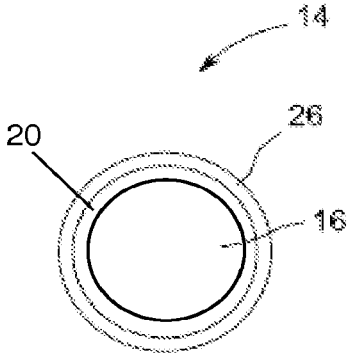
FIG. 4 is a bottom plan view of the bottom container according to the embodiment of the present invention shown in FIG. 1.

Referring to FIGS. 2 through 4, the first wall 20 is basically a cylinder that extends between the first base 16 and the top member 18 such that, the first base 16 and the top member 18 are disposed opposite to each other. The first wall 20, however, like the first base 16, can be of any shape or structure that is capable of holding a beverage between the first base 16 and the top member 18.

Still referring to FIGS. 2 through 4, the device 10 further includes an intermediate circumferential wall 26 extending upwardly from the upper rim of the first wall 20 such that, the intermediate wall 26 is perpendicular to the top member 18. The intermediate wall 26, as can be appreciated from FIG. 2, is essentially a cylinder. The interior surface of the intermediate wall 26 is lined with a plurality of guides 28 extending perpendicularly therefrom.

Figure 6:
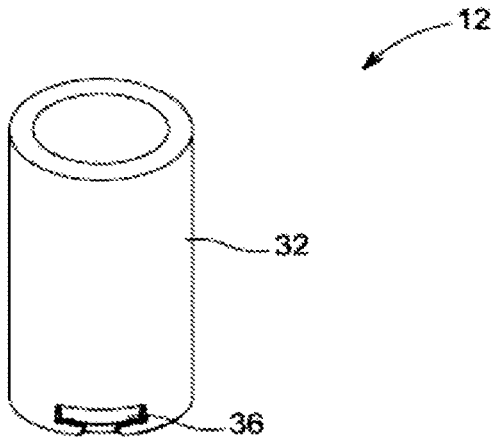
FIG. 6 is a perspective view of the top container according to the embodiment of the present invention shown in FIG. 1.
Figure 7:
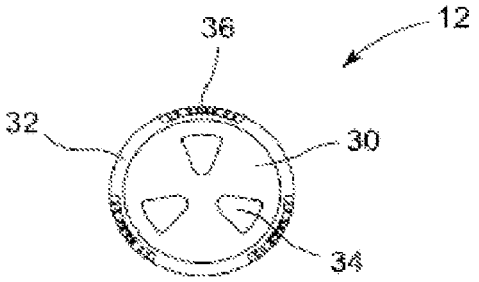
FIG. 7 is a top plan view of the top container according to the embodiment of the present invention shown in FIG. 1.
Figure 8:
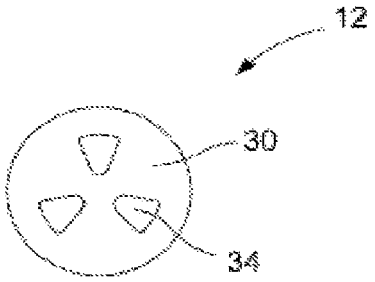
FIG. 8 is a bottom plan view of the top container according to the embodiment of the present invention shown in FIG. 1.

Referring to FIGS. 6 through 8, the top container 12 can be an open container including a second base 30, and a second circumferential wall 32 extending upwardly from the second base 30. In some embodiments, the second base 30 and the second wall 32 can be perpendicularly disposed with respect to each other. However, other angles are acceptable in the various embodiments. The second base 30, similar to the top member 12, is essentially a circular in shape. The second base 30 includes a planar top surface and an essentially planar bottom surface. One or more second openings 34 are disposed on the second base 30 as can be seen in FIGS. 7 and 8. The second openings 34 can of any number and each of which, can be of shape as long as the function thereof is not interfered with. Preferably, each second opening 24 is of triangular shape with the corners thereof being rounded off. The second wall 32 is also basically a cylinder. Essentially, however, for the sake of the functionality of the device 10, only a lower portion of the exterior surface of the second wall 32 is required to be of cylindrical shape or a conical shape with nearly parallel walls. The upper portion of the second wall 32, including both the interior and exterior surfaces thereof can be of any structural configuration.

Still referring to FIGS. 6 through 8, the exterior surface of the lower portion of the second wall 32 includes a plurality of T-tracks 36 wherein, the free extremity of each vertical section of the each T-track 36 is open-ended as it extends from the open end of the second wall 32. Each guide 28 is adapted to be slidably received within a T-track 36. In one embodiment, the surface of the each guide 28 that is parallel to the surface of the intermediate wall 26 is concave-shaped so as to enable water, beverage, or other liquids to escape, which, otherwise, would tend to get trapped between the T-tracks 36 and the guides 28. The use of the T-tracks 36, as described above results in the fixed rotation amounts. However, in some embodiments, the horizontal portion of the T-tracks 36 can be connected to allow continuous or 360 degree rotation of the containers 12 and 14 with respect to each other.

Figure 9:
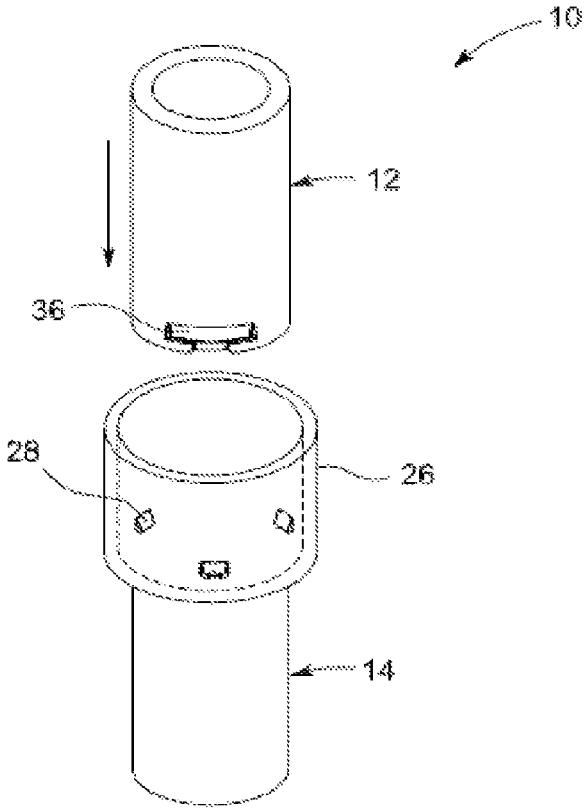
FIGS. 9 through 11 depict the top container being received within the bottom container in a sequential manner according to the embodiment of the present invention shown in FIG. 1.
Figure 10:
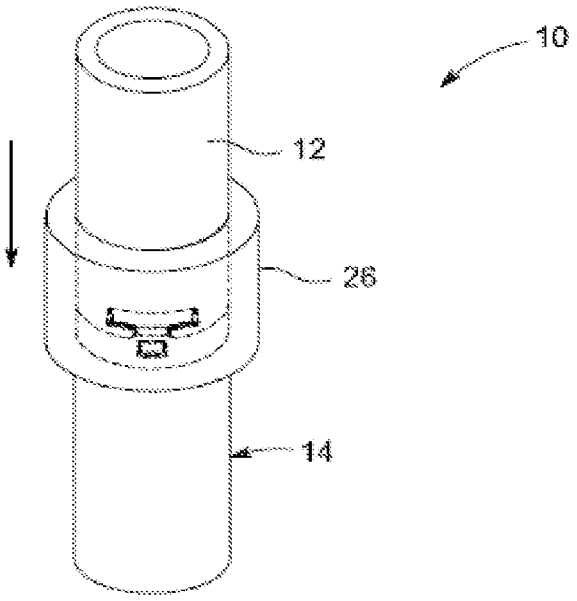
Figure 11:
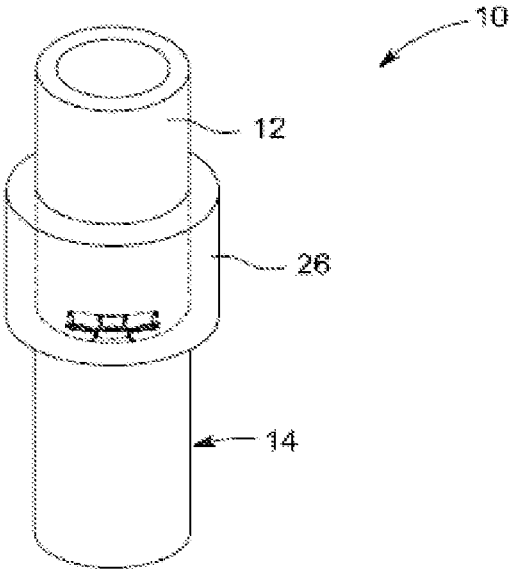
Figure 12A:
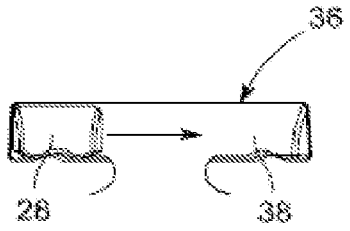
Figure 12B:
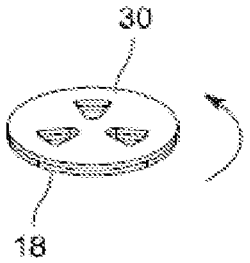
Figure 13A:
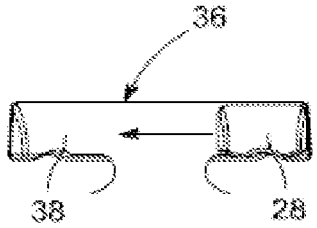
Figure 13B:
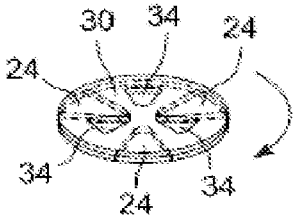

Referring to FIGS. 9 through 11, the lower portion of the exterior surface of the second wall 32 is configured such that, the top container 12 is adapted to be snugly and slidably received within the intermediate wall 26 as the guides 28 are slidably received within the T-tracks 36. The T-tracks and guides, 28 and 36, may be lined with and/or made of rubbery substance respectively so as to enable the guides 28 to be snugly received within the T-tracks 36. Each T-track 36 is positioned such that, once a guide 28 is moved to the dead end of the vertical section of the T-track 36, the bottom surface of the second base 30 and the top surface of the top member 18 abut each other. At this point, referring to FIGS. 12A and 12B, and 13A and 13B, the rotation of the top container 12 relative to the bottom container 14 is permitted as each horizontal section 38 is traversed by the corresponding guide 28. The first and second openings 24 and 34 and the track and guide mechanism 28 and 36 are configured such that, as the guides 28 traverse from one extremity of the horizontal section 38 to the other, the first and second openings 24 and 34 move from an open position to a closed position wherein, the open position is where the first and second openings 24 and 34 are aligned so as to allow for the passage of a beverage from the top container 12 to the bottom container 14 or vice versa, and the closed position is where the first and second openings 24 and 34 overlap sealing off the bottom container 14.

The top container 12 extends beyond the intermediate wall 26 so as to permit a user to twist the device 10 by holding the top and bottom containers 12 and 14. Alternatively, the T-tracks 36 may be disposed on the top container 12 while the guides 28 may be disposed on the bottom container 14 as seen in FIG. 14. Notably, in this alternate embodiment, the T-tracks 36 are inverted.

In some embodiments, the outer vertical surface of the top container 12 and the inner vertical surface of the bottom container 14 abutting the top container 12 after assembly may be flush to provide a further defense against leaking. In some embodiments, these abutting or facing surfaces can be substantially smooth to provide a better seal. As used herein, the term "substantially" refers to being at or near to the stated condition or within 20% of the stated condition or property.

Referring to FIG. 15, in one embodiment, one of the two opposing surfaces of horizontal section 38 of the T-track 36, at each extremity thereof, includes a crest 40. Further, the corresponding guide 28, the surface of which that abuts the crest 40 includes a matching crest 40 so as to achieve a snap fit between a guide 28 and either extremity of the corresponding horizontal section 38. The placement of the crest 40 also increases the pressure between the two components toward each other while in the locked position to prevent leaking. That is, the crest 40 causes the bottom container 14 to be further pulled toward or further pushed against the top container 12. As a result, this causes the top member 18 and the second base 30 to be pushed against each other. Therefore, by configuring the touching surfaces of the top member 18 and the second base 30 to have substantially corresponding shapes (e.g., both having substantially planar touching surfaces or having substantially corresponding parabolic touching surfaces), these touching surfaces abut tightly against each other when guide 28 engages with crest 40, minimizing or preventing leaks when openings 24 and 34 do not overlap, such as in FIG. 13B. In some embodiments, some or all portions of the touching surfaces of either the top member 18 and the second base 30 can be formed using resilient materials so as to further improve the seal between the containers 12 and 14.

The device can also include additional features to prevent any accidental rotation of the top container 12 with respect to the bottom container 14, or vice versa. In one particular embodiment, each of the opposing surfaces at the extremity of each vertical section of a T-track 36 can include include a bump 42 whereby, the corresponding guide 28 squeezes past vertical section through the pair of opposing bumps 42 into the horizontal section 38. This arrangement of bumps 42 minimizes the chance of any accidental disassembling of the top and bottom containers 12 and 14. Alternatively or in combination with bumps 42, the vertical section of the T-Track 36 can include a ridge 43 and the corresponding guide 28 can have a protrusion that engages with the ridge 43 when it enters the vertical section of the T-track. Thereafter, by applying force, the corresponding guide 28 squeezes or jumps past the ridge 43 in the vertical section to enter the horizontal section 38. This arrangement of ridge 43 and the guide 28 also minimizes the chance of any accidental disassembling of the top and bottom containers 12 and 14 during rotation, as force would be required to separate the components even if the ridge 43 and the corresponding guide 28 are lined up.

Further, this arrangement provides a haptic feedback to the user. That is, the act of engaging the guide 28 and the crest 40 causes, as described above, a snap fit. Thus, when the user feels that the guide 28 is locked in place with the crest 40, the user knows that the a seal between the container 12 and 14 has been formed, In some embodiments, there may be no crest 40. To provide the necessary pressure or force to seal the top container 12 from the bottom container 14, the dimension of the T-track 36 and the corresponding guide 28 can be selected such that once the guide 28 is in the horizontal section 38, the necessary force is applied. In other embodiments, part or all of the horizontal section 38 may be sloped or have a rise to provide the same functionality as crest 40.

In one embodiment (not shown), inverted L-tracks may be employed in lieu of the T-tracks 36 whereby, the top container 12 is longitudinally received within the bottom container 14 as the guides 28 traverse the vertical section of the L-tracks and the top container 12 is rotated relative to the bottom container 14 as the guides 28 traverse the horizontal parts of the L-tracks.

Referring to FIGS. 16 through 18, in one alternative embodiment of the present invention, the top container 12, instead of the bottom container 14, includes the intermediate wall 26 that extends downwardly from the lower rim of the second wall member 32 whereby, the bottom container 14 is slidably received within the top container 12 by means of the track and guide mechanism disposed on the intermediate wall 26 and the bottom container 14. In one alternative embodiment of the present invention, the T-tracks may be disposed on the exterior surface of the container while the guides are disposed on the interior surface of the intermediate wall member or vice versa.

In one embodiment, referring to FIGS. 19A and 19B, the device 10 is configured such that, outer surfaces of the cylindrical walls of the top and bottom containers 12 and 14 are flush with the outer surface of the intermediate wall. This causes the device 10 to be of uniform outer cross-section whereby, the handling of the device is made easier. Further, by using of flush surfaces that abut tightly against each other, a further defense against leaks is provided. In one embodiment, the surfaces are preferably smooth surfaces.

Referring back to FIG. 1 (and FIG. 19A), when two different beverages, say, for example, a shot and a chaser, are to be served in the device 10, first, a chaser is poured into the empty device 10 in the open position, which leads to the chaser being settled in the bottom container 14. Once the bottom container 14 is filled with the chaser, the device 10 is 'twisted' to the closed position upon which, the shot is poured thereinto whereby, the shot is retained in the top container 12. The user, upon drinking up the shot, has to simply twist the device 10 to the open position in order to consume the chaser in the bottom container 14. The device 10 may be made of different sizes and materials and may be adapted for other application areas (other than alcohol consumption) where there is a need or relevance for sequential consumption of liquids. For example, the device can be used in the context of sequential consumption of liquid medicine, powders, granular substances, or tablets.

The present disclosure contemplate that the various portions of the device can be manufactured using any type of materials. For example, in some embodiments, the device can be manufactured using plastic or paper materials. Further, the device materials can be selected such that part or all of the device is disposable or otherwise intended for single or few uses. However, the various embodiments are not limited to any particular type of material for any portion of the device.

Further, the present disclosure also contemplates that the device can include decorative features, such as use of different colors, lighting, or other decorative features in any or all parts of the device.

Additionally, although a device in a dual container configuration is described above, the various embodiments are not limited in this regard. Rather, a device in accordance with the various embodiments can include additional containers. That is, the top container in the illustrated embodiments can serve as a bottom container for an additional container and the top container and the additional container can be configured as described above. Moreover, the device can be included to include any number of containers.

Further, a device in accordance with the various embodiments can also include a lid (not show). In some embodiments, the lid can be a sheet of foil or paper can be adhered to the top opening of the device and that is peeled or otherwise removed as needed. In other embodiments, a bottle cap, a screw-on cap, a cork, or other sealing mechanism can be utilized to provide a lid. In yet other embodiments, the lid can be attached to the top opening in a manner similar to that described for the first base 16 in FIGS. 5A-5F.

Additionally, a device in accordance with the various embodiments can include features to assist the user in distinguishing the top container 12 from the bottom container 14 to facilitate twisting. Such features can be colors, images or logos, handles, tabs, bumps, textures, or any other indicia, visible or mechanical to allow the user to distinguish the different components. However, the various embodiments are not limited to any particular type of features for this purpose.

A device in accordance with the various embodiments can also be configured to have various "locked" positions to provide a filtering arrangement. That is, various crests (not shown) can be provided in the T-Track 36. Thus, when guide 28 engages with each of these tracks, different amounts of overlap between the openings 24 and 34 can be provided to filter items. Such a configuration can be useful for mixing and filtering various types of items. For example, in the case of a martini drink, ice can be placed in the device with the openings 24 and 24 configured and arranged to allow ice to travel from the top container 12 to the bottom container 14. Vodka, gin, or other items can be placed in the top container 12, with the device arranged to provide a seal between the containers 12 and 14. When the drink is ready to be mixed, the device can be manipulated to allow the items in the top container 12 to enter the bottom container 14. The device can then be shaken, using a lid or by re-manipulating to form a seal between the containers. Afterwards, to pour the drink, the device can be manipulated again to cause the openings to overlap such that ice cannot leave the bottom container 12. Alternatively, various sized opening can be provided, each associated with a different one of the crests. Other uses for such filtering are possible. For example, the bottom container 14 can be used for holding fruit, tea bags, coffee bags, or any other type of items for which it is desirable, at least temporarily, to prevent their exiting the bottom container when a liquid or other consumable mixed therewith is poured from the device.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of the various embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall therebetween.

What is claimed is:

1. A container device comprising:

a first container comprising a first base, a top member comprising one or more first openings, and a first circumferential wall configured to receive the first base, the first circumferential wall extending between the first base and the top member; and a second container comprising a second circumferential wall and a second base comprising one or more second openings; and an intermediate circumferential wall configured to receive the first container and the second container at an interior surface of the intermediate circumferential wall, wherein the first container and the second container are configured to rotate respective to each other between and an open position and a closed position when received by the intermediate circumferential wall, wherein the one or more first openings overlap with the one or more second openings in the open position and the one or more first openings are non-overlapping with the one or more second openings in the closed position, and wherein the top member and the second base abut each other, thereby forming an abutting surface, and the abutting surface is a parabolic surface.

2. The container device of claim 1, wherein the second circumferential wall receives the first base via threads disposed on the exterior of the first base and corresponding threads disposed on the interior of the first circumferential wall.

3. The container device of claim 1, wherein the first base comprises a central circular track along an exterior circumference of the first base.

4. The container device of claim 3, wherein the first container further comprises an o-ring received in the central circular track of the first base.

5. The container device of claim 4, wherein the second circumferential wall receives the o-ring at an interior portion of the top member.

6. The container device of claim 1, wherein portions of the circumferential wall abutting the first base are thinner than remaining portions of the circumferential wall.

7. The container device of claim 1, wherein the top member comprises a circular shape and a parabolic first surface, wherein the parabolic first surface abuts the second base when the first container and the second container are received by the intermediate circumferential wall.

8. The container device of claim 7, wherein the top member comprises a rubber-like lining along the parabolic first surface.

9. The container device of claim 1, wherein the intermediate wall comprises a plurality of guides along the interior surface.

10. The container device of claim 1, wherein a shape of the second base corresponds to the top member.

11. The container device of claim 1, wherein the second circumferential wall comprises a conical shape.

12. The container device of claim 1, wherein the intermediate circumferential wall comprises at least one protrusion, and the first container comprises at least one receiving portion.

13. The container device of claim 12, wherein the at least one receiving portion comprises a rubber-like lining.

14. The container device of claim 13, wherein the at least one receiving portion comprises a vertical portion and a horizontal portion.

15. The container device of claim 13, wherein the at least one receiving portion comprises at least one of:

a narrowed portion along the vertical portion, at a location where the vertical portion abuts the horizontal portion;

a narrowed portion along the horizontal portion, closer to the vertical portion than an end portion of the horizontal portion; and a narrowed portion along the horizontal portion, closer to the end portion than the vertical portion.

16. The container device of claim 15, wherein the narrowed portion comprises a crest.

17. The container device of claim 15, wherein the narrowed portion comprises an inclined slope.

* * * * *